United States Patent [19]

Zacek

[11] Patent Number: 4,821,778

[45] Date of Patent: Apr. 18, 1989

[54] CIRCULAR LOOM

[75] Inventor: Franz Zacek, Vöcklabruck, Austria

[73] Assignee: Lenzing Aktiengesellschaft, Austria

[21] Appl. No.: 71,398

[22] Filed: Jul. 9, 1987

[30] Foreign Application Priority Data

Jul. 14, 1986 [AT] Austria ..... 1904/86

[51] Int. Cl.[4] ..... D03D 37/00

[52] U.S. Cl. ..... 139/13 R

[58] Field of Search ..... 139/13 R, 13 A, 15

[56] References Cited

U.S. PATENT DOCUMENTS 4,509,562 4/1985 Schonberger et al. ..... 139/13 R
4,619,293 10/1986 Huemer ..... 139/13 R

FOREIGN PATENT DOCUMENTS 370787 of 1983 Austria .
3323141 of 1984 Fed. Rep. of Germany .

*Primary Examiner*—Henry S. Jaudon
*Attorney, Agent, or Firm*—Ostrolenk, Faber, Gerb & Soffen

[57] ABSTRACT

In a circular loom having a machine frame and a lower and an upper circular-ring-shaped running race arranged in the machine frame for guiding a shuttle, the running rollers of the same are fitted in between inclined guiding surfaces of the upper and lower running races.

To keep low wear of the running rollers and to ensure smooth running of the shuttle, (a) the guiding surfaces are inwardly inclined, i.e. formed to diverge to the middle axis of the circular loom, (b) the shuttles are journaled with running rollers having frustoconical running surfaces on the guiding surfaces, (c) for each of the running rollers, the tip of the cone forming the frustoconical running surfaces are on the middle axis of the circular loom and (d) the tip of the cone forming the frustoconical running surface of a running roller coincides with the tip of the imaginarily extended pertaining frustoconical guiding surface.

6 Claims, 2 Drawing Sheets

CIRCULAR LOOM

Figure 1:
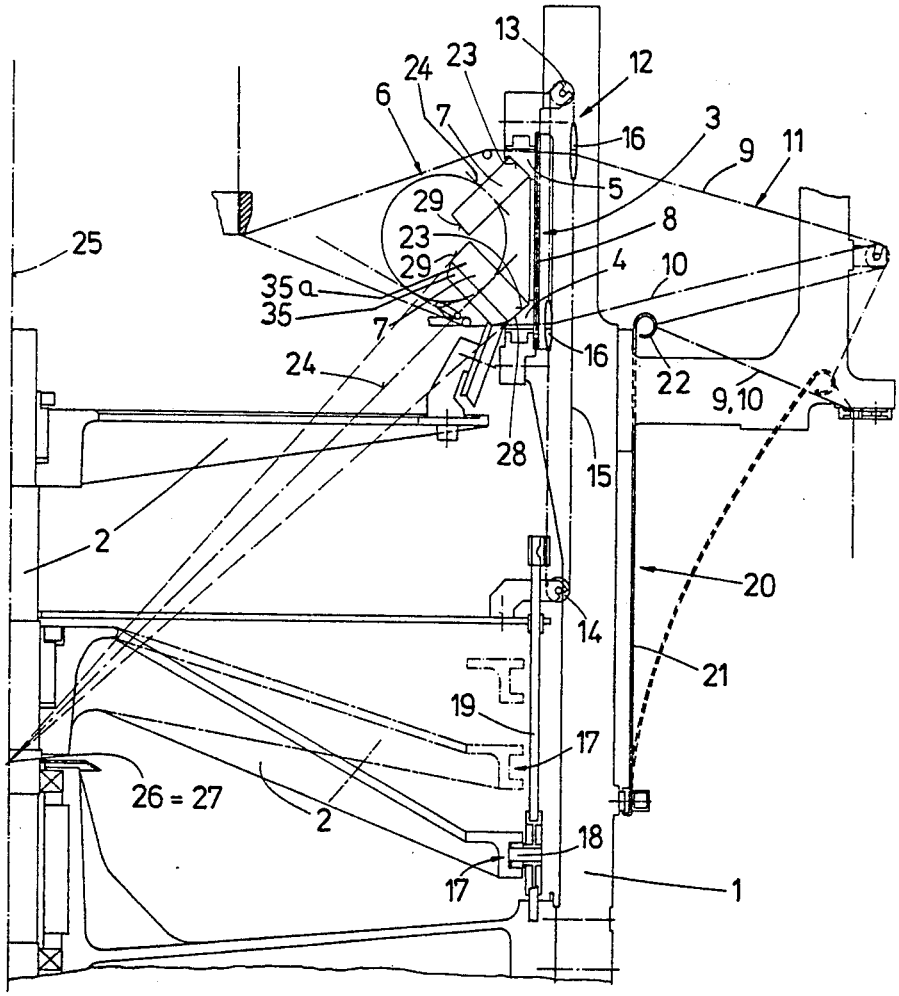

The invention relates to a circular loom having a machine frame and a lower and an upper circular running race arranged in the machine frame for guiding a shuttle whose running rollers are fitted in between oblique guiding surfaces of the upper and the lower running races.

A circular loom of this kind, in which the guiding surfaces are formed so as to diverge to the middle axis of the machine is known from Austria Pat. No. 370,787. In the circular loom known from this document, the running rollers of the shuttle have rotation axes arranged in parallel to the guiding surfaces into which they are fitted. The running rollers themselves have convexly cambered running surfaces to avoid sliding between the running rollers and the guiding surfaces, so that only a point contact occurs between the running rollers and the guiding surfaces.

This has the advantage that the shuttles run smoothly, it has, however, also the disadvantage that the specific surface pressure between the running rollers and the guiding surfaces is very high due to the punctiform contact area of the running wheels on the guiding surfaces, possibly resulting in a high stress and an increased wear of the running rollers and the guiding surfaces. When the shuttle runs over the warp threads, this involves a very high stress on the warp threads.

The invention aims at avoiding these disadvantages and difficulties and has as its object to provide a circular loom of the initially defined kind, in which in spite of a smooth running of the shuttles, the stress on the running rollers and on the guiding surfaces, respectively, and thus their wear is as slight as possible. Furthermore, damage to the warp threads, e.g. breaking of the warp threads or deformation of the warp threads, if the latter are formed for instance of a synthetic material, are to be avoided.

According to the invention, this object is achieved by a combination of the following features:

(a) that the guiding surfaces are obliquely inwardly inclined, i.e. diverging towards the middle axis of the circular loom, (b) that the shuttles are journaled with running rollers having frustoconical running surfaces on the guiding surfaces only, (c) that for each of the running rollers the tip of the cone forming the frustoconical running surfaces lies on the middle axis of the circular loom, and (d) that the tip of each cone forming the frustoconical running surface of a running roller coincides with the tip of the imaginarily extended pertaining frustoconical guiding surface.

By the fact that the rotation axes of the running rollers are not directed in parallel to the guiding surfaces, but are arranged inclinedly thereto, it is possible to form the running surfaces frustoconically and to provide a linear contact between the running rollers and the guiding surfaces, wherein over the entire length of the linear contact between the running surfaces of the running rollers and the guiding surfaces, no sliding movement occurs, but a pure rolling movement. Thereby the wear of the running rollers can be minimized with a high running smoothness of the shuttles.

A circular loom with running races having frustoconical guiding surfaces, at which the shuttles are guided by means of running rollers having frustoconical running surfaces is known from German Pat. No. 33 23 141. Therein the guiding surfaces are outwardly inclined, i.e. they converge in the direction towards the middle axis of the circular loom. While the machine is in operation, the shuttles are thereby pressed towards the outside, against the reed, due to the centrifugal force, and the running rollers are lifted off the guiding surfaces. Therein, the shuttles are either supported on rotatable reed rods via rockers arranged on the shuttles, or they comprise additional supporting rollers running off the reed rods. This results not only in a higher sliding or rolling resistance for the shuttles, but also in a more complex construction and a high noise level when the machine is operated.

An advantageous further development according to the invention of the running rollers is characterised in that at least the running rollers contacting the upper guiding surface have, on their outer sides, a flange projecting beyond their running surfaces, preferably a frustoconical flange, contacting an also circular-ring-shaped supporting surface inclinedly arranged to the upper guiding surface and following upon the latter, whereby an inward-tilting of the shuttle is prevented when the shuttle stands still.

According to another embodiment, a supporting ring is arranged for this purpose at the inner side of the upper guiding surface, which supporting ring contacts one side face of the upper running rollers each.

According to a further preferred embodiment, the upper running race has a longitudinal groove for preventing an inward-tilting of the shuttle standing still, whose groove bottom forms the guiding surface for the running rollers and whose side flanks are arranged at a distance corresponding to the thickness of a running wheel and approximately in parallel to the side faces of the running wheels.

For providing a smooth drive for the shuttles with little friction and a slight wear, a running roller engaging the lower guiding surface is provided on its inner side with a frustoconical projection that has a larger aperture angle than the running surface of the running roller, and a drive roller arranged at a rotor has a V-shaped section, a frustoconical surface of which contacts the frustoconical projection and the tip of the frustoconical projection coincides with the tip of the frustoconical surface.

Figure 2:
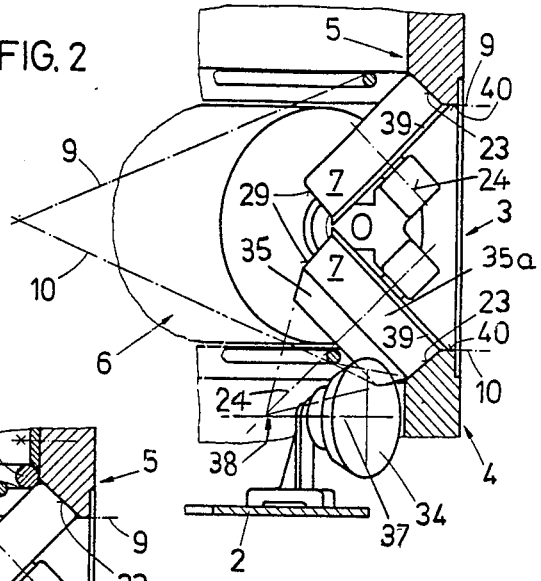
Figure 3:
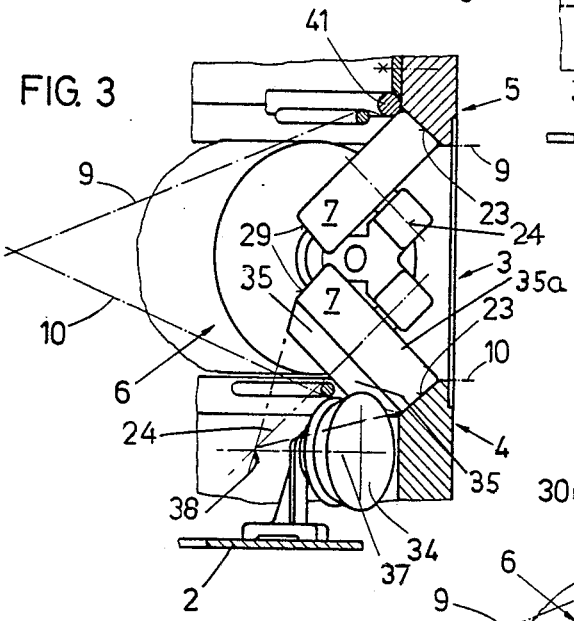
Figure 4:
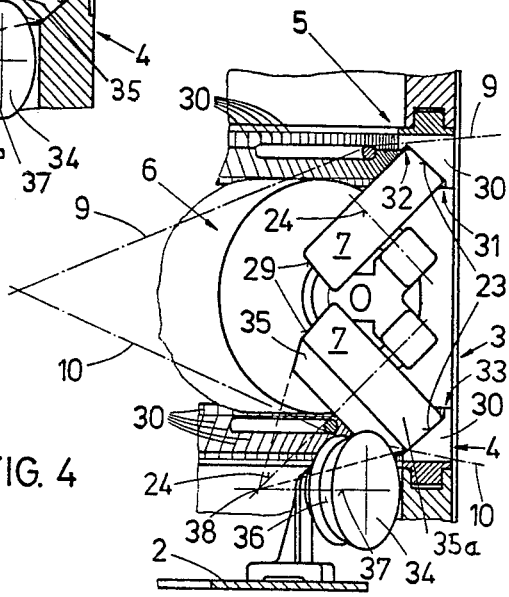

The invention will now be explained in more detail by way of several exemplary embodiments, wherein FIG. 1 shows a vertical section through the middle axis of a circular loom;

FIGS. 2 to 4 each show further embodiments in illustrations analogous to FIG. 1 and on an enlarged scale.

The circular loom has a drivable rotor 2 rotatably journaled in a machine frame 1, which rotor 2 is arranged below a stationary circular-cylindrical reed 3. The reed 3 is delimited by a lower and an upper running race 4, 5 of circular-ring shape each, along which running races at least one shuttle 6 is guided by means of running rollers 7. Between the rnning races 4, 5 rods 8 of the reed 3 connecting the running races are provided, between which rods the warp threads 9, 10 are guided.

For forming a shed 11 by the warp threads 9, 10, harnesses 12 concentrically surrounding the reed 3 are provided, which harnesses are formed by belts 15 formed into a continuous loop and guided over upper and lower deflection pulleys 13, 14, a thread guiding eye 16 being fastened on either side of each belt. For actuating the harnesses 12, the rotor 2 is provided with a cam 17 extending wave-like around the periphery with regard to its height, at which cam followers 18 are guided. The cam followers 18 are connected with the belts 15 by means of actuating rods 19. At the outer side of the machine frame 1, thread tensioning means 20 for the warp threads 9, 10 are provided, which are formed by spring wires 21 equipped with thread eyes 22 at their ends.

As can be seen from FIG. 1, the running races 4, 5 have guiding surfaces 23 for the running rollers 7 of the shuttle 6, which are formed to be obliquely inwardly inclined so as to diverge towards a middle axis 25 oriented longitudinally through a center line of the loom. The running rollers 7 of the shuttle 6 are frustoconical. The lower running roller 7 having two frustoconical portions 35 and 35a (see FIG. 4), as will be discussed below. The rotation axes 24 of the running rollers 7 intersects the middle axis 25 of the circular loom in point of intersection 26. The point of intersection 26 of the rotation axes 24 of the lower running rollers coincides with the point of intersection of a line extending from the guiding surface 23 to the middle axis 25 of the circular loom. The line extending from the guide surface 23 to the middle axis 25 forms a truncated cone symmetric about, and having a central axis located at, loom middle axis 25. In other words, both the tip 26 of the frustoconical running rollers and the tip 27 of a truncated cone formed by a line extending from guide surface 23 to middle axis 25 each lie on the middle axis 25 and coincide. Thereby it is ensured that no sliding movement, but a pure rolling movement occurs along the contact line 28 of the running surface 29 of a running roller 7 and the guiding surface 23 of the pertaining running race 4 or 5, respectively. The wear between the running rollers 7 and the guiding surfaces 23 of the running races 4 or 5, respectively, thus can be kept extremely low, a high running smoothness being ensured.

According to the exemplary embodiment illustrated in FIG. 4, the warp threads 9, 10 are guided through thread guiding grooves 30 of the running races 4, 5, which thread guiding grooves are arranged to be approximately transverse to the running races 4, 5, so that a contact of the running rollers 7 with the warp threads 9, 10 is avoided. If, however, the warp threads are not guided in thread guiding grooves, but along the guiding surfaces 23 of the running races 4, 5, the warp threads 9, 10 are extremely gently treated due to the linear contact between the running rollers 7 and the running races 4, 5 and the pure rolling movement of the running rollers 7 at the guiding surfaces, this also being so at high rotational speeds of the shuttle 6 and high centrifugal forces occuring therewith.

For avoiding an inward tilting of the shuttle when the circular loom stands still, according to the embodiment illustrated in FIGS. 1 and 4, a longitudinal groove 31 is machined into the upper running race 5, whose groove bottom forms the guiding surface 23. When the machine stands still, the upper running wheels 7, due to the tilting moment acting on the shuttle 6, are supported against the upper side wall 32 of the longitudinal groove 31. The lower running race 4 has a collar 33 at its upper part facing the reed 3, at which collar the lower running rollers 7 of the shuttle 6 get to lie when the machine stands still.

For driving the shuttle, a drive roller 34 is rotatably journaled on the rotor 2, which drive roller contacts a frustoconical projection 35 of a running roller 7. The drive roller 34 has a V-shaped section, one surface 36 contacting the frustoconical projection 35. It is to be noted that the axis 24 of the frustoconical projection 35 of the running roller 7 intersects with the axis 37 of the also frustoconically designed surface 36 contacting this projection, the point of intersection of the axes 24 and 37 being the tip 38 of the frustoconical projection 35 of the lower running roller as well as the tip 38 of the surface 36 of the drive roller 34 contacting this projection 35. The other surface of the V-shaped section preferably serves for preventing the running surface 29 of the lower running roller 7 from sliding off the guiding surface 23 of the running race 4.

According to the embodiment illustrated in FIG. 2, the running rollers 7 of the shuttle on their outer sides are each provided with a frustoconical flange 39 projecting beyond the running surface 29, which flange, at a stand-still of the machine, contacts a circular-ring-shaped supporting surface 40 of the running races 4 or 5, respectively, which supporting surface is arranged at an angle to the guiding surfaces 23, so that the shuttle 6 is safely held between the running races 4, 5 also when the machine stands still.

According to FIG. 3, a supporting ring 41 having a circular cross-section is mounted on the upper running race 5 at the inner side thereof for holding the shuttle 6 when the machine stands still.

What I claim is:

1. A circular loom having a middle axis and comprising a machine frame, a rotor, a lower and an upper circular running race arranged in said machine frame, and a shuttle guided by said lower and said upper circular running races, said lower and upper running races having lower and upper guiding surfaces, respectively, which are inwardly inclined so as to diverge towards said middle axis of said loom, said shuttle having lower and upper running rollers with frustoconical running surfaces which contact and ride on said lower and upper guiding surfaces, respectively, of said lower and upper circular running races, means associated with at least one of said running races for preventing sliding of the rollers in a direction perpendicular to the middle axis;

said lower and upper running rollers being disposed at an angle with respect to said middle axis such that a line extending along the rotational axis of said running rollers forms an imaginary truncated cone with a tip disposed on said middle axis of said loom, and lines extending from the frustoconical running surfaces of said lower and upper running rollers from respective imaginary having cones having tips disposed at the middle axis of the circular loom, the tips of the imaginary cones formed by extending lines from the frustoconical running surfaces of the lower running rollers coinciding with the top of the imaginary cone formed by extending a line along the rotational axis of the lower rollers, and the tips of the imaginary cones formed by extending lines from the frustoconical running surfaces of the upper running rollers coinciding with the tip of the imaginary cone formed by extending a line along the rotational axis of the upper rollers.

2. A circular loom having a middle axis and comprising a machine frame, a rotor, a lower and an upper circular running race arranged in said machine frame, and a shuttle guided by said lower and said upper circular running races, said lower and upper running races having lower and upper guiding surfaces, respectively, which are inwardly inclined so as to diverge towards said middle axis of said loom, said shuttle having lower and upper running rollers with frustoconical running surfaces which contact and ride on said lower and upper guiding surfaces, respectively, of said lower and upper circular running races, said lower and upper running rollers being disposed at an angle with respect to said middle axis such that a line extending along the rotational axis of said running rollers forms an imaginary truncated cone with a tip disposed on said middle axis of said loom, and lines extending from the frustoconical running surfaces of said lower and upper running rollers form respective imaginary cones having tips disposed at the middle axis of the circular loom, the tips of the imaginary cones formed by extending lines from the frustoconical running surfaces of the lower running rollers coinciding with the tip of the imaginary cone formed by extending a line along the rotational axis of the lower rollers, and the tips of the imaginary cones formed by extending lines from the frustoconical running surfaces of the upper running rollers coinciding with the tip of the imaginary cone formed by extending a line along the rotational axis of the upper rollers, wherein at least said running rollers which contact the upper guiding surface have a flange projecting beyond their running surfaces, said flange located on the outer side of said running rollers with respect to said middle axis, and wherein a circular-ring-shaped supporting surface is provided on said running race, said circular-ring-shaped supporting surface being inclined relative to said upper guiding surface, and flange contacting said circular-ring-shaped supporting surface.

3. A circular loom as set forth in claim 2, wherein said flange is frustoconical.

4. A circular loom having a middle axis and comprising a machine frame, a rotor, a lower and an upper circular running race arranged in said machine frame, and a shuttle guided by said lower and said upper circular running races, said lower and upper running races having lower and upper guiding surfaces, respectively, which are inwardly inclined so as to diverge towards said middle axis of said loom, said shuttle having lower and upper running rollers with frustoconical running surfaces which contact and ride on said lower and upper guiding surfaces, respectively, of said lower and upper circular running races, said lower and upper running rollers being disposed at an angle with respect to said middle axis such that a line extending along the rotational axis of said running rollers forms an imaginary truncated cone with a tip disposed on said middle axis of said loom, and lines extending from the frustoconical running surfaces of said lower and upper running rollers form respective imaginary cones having tips disposed at the middle axis of the circular loom, the tips of the imaginary cones formed by extending lines from the frustoconical running surfaces of the lower running rollers coinciding with the tip of the imaginary cone formed by extending a line along the rotational axis of the lower rollers, and the tips of the imaginary cones formed by extending lines from the frustoconical running surfaces of the upper running rollers coinciding with the tip of the imaginary cone formed by extending a line along the rotational axis of the upper rollers, a supporting ring arranged on the inner side of said upper guiding surface for contacting a side face of each of the upper running rollers.

5. A circular loom having a middle axis and comprising a machine frame, a rotor, a lower and an upper circular running race arranged in said machine frame, and a shuttle guided by said lower and said upper circular running races, said lower and upper running races having lower and upper guiding surfaces, respectively, which are inwardly inclined so as to diverge towards said middle axis of said loom, said shuttle having lower and upper running rollers with frustoconical running surfaces which contact and ride on said lower and upper guiding surfaces, respectively, of said lower and upper circular running races, said lower and upper running rollers being disposed at an angle with respect to said middle axis such that a line extending along the rotational axis of said running rollers forms an imaginary truncated cone with a tip disposed on said middle axis of said loom, and lines extending from the frustoconical running surfaces of said lower and upper running rollers form respective imaginary cones having tips disposed at the middle axis of the circular loom, the tips of the imaginary cones formed by extending lines from the frustoconical running surfaces of the lower running rollers coinciding with the tip of the imaginary cone formed by extending a line along the rotational axis of the lower rollers, and the tips of the imaginary cones formed by extending lines from the frustoconical running surfaces of the upper running rollers coinciding with the tip of the imaginary cone formed by extending a line along the rotational axis of the upper rollers, said upper running race has a longitudinal groove having a groove bottom and side flanks, said groove bottom forming said guiding surfaces for said running rollers and said side flanks being arranged at a distance corresponding to the thickness of a running roller and directed approximately in parallel to the side faces of said running roller.

6. A circular loom having a middle axis and comprising a machine frame, a rotor, a lower and an upper circular running race arranged in said machine frame, and a shuttle guided by said lower and said upper circular running races, said lower and upper running races having lower and upper guiding surfaces, respectively, which are inwardly inclined so as to diverge towards said middle axis of said loom, said shuttle having lower and upper running rollers with frustoconical running surfaces which contact and ride on said lower and upper guiding surfaces, respectively, of said lower and upper circular running races, said lower and upper running rollers being disposed at an angle with respect to said middle axis such that a line extending along the rotational axis of said running rollers forms an imaginary truncated cone with a tip disposed on said middle axis of said loom, and lines extending from the frustoconical running surfaces of said lower and upper running rollers form respective imaginary cones having tips disposed at the middle axis of the circular loom, the tips of the imaginary cones formed by extending lines from the frustoconical running surfaces of the lower running rollers coinciding with the tip of the imaginary cone formed by extending a line along the rotational axis of the lower rollers, and the tips of the imaginary cones formed by extending lines from the frustoconical running surfaces of the upper running rollers coinciding with the tip of the imaginary cone formed by extending a line along the rotational axis of the upper rollers, wherein a running roller engaging said lower guiding surface is provided with a frustoconical projection on its inner side, said frustoconical projection having a larger aperture angle than the running surface of the running roller, and wherein a drive roller having a V-shaped section is provided on said rotor, a frustoconical surface of said V-shaped section contacting said frustoconical projection, the tip of said frustoconical projection coinciding with the tip of said frustoconical surface.

* * * * *

UNITED STATES PATENT AND TRADEMARK OFFICE

CERTIFICATE OF CORRECTION

PATENT NO. : 4,821,778

DATED : April 18, 1989

INVENTOR(S) : Franz Zacek

It is certified that error appears in the above-identified patent and that said Letters Patent is hereby corrected as shown below:

Col. 4, line 54, change "from" to --form-- and delete "having";

Col. 4, line 59, change "top" to --tip--;

Col. 5, line 39, change "and" to --said--.

Signed and Sealed this

Tenth Day of March, 1992

*Attest:*

HARRY F. MANBECK, JR.

*Attesting Officer*

*Commissioner of Patents and Trademarks*